US009482020B2

(12) United States Patent
Hayman

(10) Patent No.: US 9,482,020 B2
(45) Date of Patent: Nov. 1, 2016

(54) METHOD OF ASSEMBLING AN OFFSET WORKING PLATFORM ON A SCAFFOLD STRUCTURE USING A FOLDABLE KNEE-OUT SCAFFOLD FRAME MEMBER

(71) Applicant: Deltak Manufacturing, Inc., Walker, LA (US)

(72) Inventor: Yates W Hayman, Walker, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 360 days.

(21) Appl. No.: 14/066,139

(22) Filed: Oct. 29, 2013

(65) Prior Publication Data

US 2014/0325825 A1 Nov. 6, 2014

Related U.S. Application Data

(62) Division of application No. 12/824,314, filed on Jun. 28, 2010, now abandoned.

(60) Provisional application No. 61/227,250, filed on Jul. 21, 2009.

(51) Int. Cl.
*E04G 5/06* (2006.01)
*E04G 5/00* (2006.01)

(52) U.S. Cl.
CPC ..... *E04G 5/061* (2013.01); *E04G 5/006* (2013.01); *Y10T 29/49627* (2015.01); *Y10T 29/49947* (2015.01)

(58) Field of Classification Search
CPC ..... E04G 5/061; E04G 5/006; E04G 1/15; E04G 1/152; E04G 7/00; E04G 7/005; E04G 7/14; E04G 7/16; E04G 7/307; E04B 1/19; E04B 2002/8688; Y10T 29/49947; Y10T 29/49623; Y10T 29/49625; Y10T 29/49627
See application file for complete search history.

(56) References Cited

U.S. PATENT DOCUMENTS

| | | | | |
|---|---|---|---|---|
| 3,510,097 | A * | 5/1970 | McCaleb | E04G 3/20 182/150 |
| 4,445,307 | A | 5/1984 | Puccinelli et al. | |
| 4,821,844 | A | 4/1989 | Huffman et al. | |
| 5,028,164 | A | 7/1991 | Williams | |
| 5,078,532 | A | 1/1992 | Williams | |
| 5,307,899 | A | 5/1994 | Lubinski | |
| 5,503,358 | A * | 4/1996 | Lapp | E04G 5/06 182/82 |
| 5,524,727 | A * | 6/1996 | Yennie, Jr. | E04G 5/06 182/150 |
| 5,647,452 | A | 7/1997 | Gauthier | |
| 6,003,631 | A | 12/1999 | Knauth | |
| 7,971,686 | B1 | 7/2011 | Hayman | |
| 8,047,330 | B1 | 11/2011 | English | |
| 8,136,633 | B2 | 3/2012 | Rogers | |
| 8,206,052 | B1 | 6/2012 | Hayman | |
| 2007/0056799 | A1 | 3/2007 | Leidner | |

* cited by examiner

*Primary Examiner* — Sarang Afzali
(74) *Attorney, Agent, or Firm* — Jones Walker LLP

(57) ABSTRACT

A method of assembling an offset working surface on a scaffold. The method uses a scaffold knee-out member having a first and second scaffold members that are pivotally connected. A scaffold connector is positioned on an opposite end of each of the first and second scaffold members remote from the pivot point. Preferably, both connectors are pivotally connected to their respective scaffold members. One of the scaffold members of the knee-out end is coupled to a vertical scaffold, and then the other scaffold member of the knee-out is moved appropriately to allow the first and second scaffold members to pivot with respect to each other, until the other scaffold member is positioned to be coupled to a vertical scaffold member.

7 Claims, 4 Drawing Sheets

METHOD OF ASSEMBLING AN OFFSET WORKING PLATFORM ON A SCAFFOLD STRUCTURE USING A FOLDABLE KNEE-OUT SCAFFOLD FRAME MEMBER

PRIORITY

This application is a divisional of U.S. application Ser. No. 12/824,314, filed on Jun. 28, 2010, now abandoned, which application claimed the priority benefit of U.S. provisional application No. 61/227,250, filed on Jul. 21, 2009, the contents of both are hereby incorporated by reference.

BACKGROUND OF INVENTION

Scaffolding comprises horizontal scaffold members 1500 and vertical scaffold members 1000 connected into a frame structure. Generally, a complete frame is composed of rectangular scaffold structures joined together. Attached to, or resting on the horizontals of the scaffold frame structure, at particular heights, are scaffold planks used to create an elevated working surface. At times, a second elevated working surface may be needed that is connected to, but offset from, the scaffold frame structure. See FIG. 1. As shown in FIG. 1, an offset working surface is created by using a triangular shaped frame member 900 connected to the scaffold frame (generally, to vertical members of the frame). The triangular member 900 is comprised of a first frame member A and a second frame member B rigidly connected at an angle $\alpha$ less that 90 degrees but greater than zero degrees. The free end of frame members A and B terminate in a connector C that attaches to the scaffold frame. Alternatively, the free end of frame member A may terminate in a connector C while the free end of member B terminates in a shape to engage and be supported by a vertical member, such as a portion of a cylinder. (see FIG. 1, where member A terminates in a latchable member, while member B terminates is a ¼ cylinder shape).

Two triangular frame members 900 (each considered a "knee-out frame member") are attached to the scaffold frame at the same vertical height, but separated horizontally. This creates a knee-out frame structure to which scaffold planks may be supported or attached, to form the offset working platform. Vertical members 1000A may be attached at the edge of the knee-out platform, with horizontal members therebetween, to form a safety fence and provide a more safe working surface. Note that the knee-out frame member's far end 905 is not supported by a vertical scaffold member, allowing the knee-out platform to extend over structures without interference from the structure (such as a tank).

Modular scaffolding is a system scaffold having horizontal scaffold members and vertical scaffold members designed to be clipped or coupled together at a scaffold joint, to create a scaffold structure. A scaffold joint comprises a connector on the vertical scaffold member that is designed to couple or mate with a connector on a horizontal scaffold member, thereby joining together a horizontal and vertical scaffold member. One type of modular scaffold joint uses an end connector positioned on the end of a horizontal member, where the end connector has lip or hook sections. The lip sections are designed to engage or rest on cups or annuli rings positioned on a vertical scaffold member. One such joint is disclosed in U.S. Pat. No. 4,445,307, hereby incorporated by reference. A second type of latching connector is disclosed in U.S. Pat. Nos. 5,078,532 and 5,028,164, hereby incorporated by reference. A third type of latching mechanism is that disclosed in U.S. application Ser. No. 11/738, 273, filed Apr. 20, 2007 (hereby incorporated by reference). And a fourth type of latching mechanism is disclosed in U.S. patent application Ser. No. 12/489,166 filed on Jun. 22, 2009, entitled "Scaffold end connector" (hereby incorporated by reference).

On each of these modular systems, the horizontal and vertical scaffold members are preferably constructed of hollow steel pipe, preferably galvanized pipe. A commonly used pipe is 1¾ inch diameter steel pipe, having ⅛ inch wall thickness.

As described, typically a knee-out frame member are constructed to create 3, 4, or 5 foot cantilevered trusses used to support a outlying platform. Extensions beyond 5 feet are possible, but difficult to assemble by hand as the triangular knee-out frame members are rigid structures that are bulky, hard to maneuver, and for modular scaffold section, very heavy. As such, they are difficult to attach to a scaffold frame by manual labor.

PREFERRED EMBODIMENT

Figure 1:
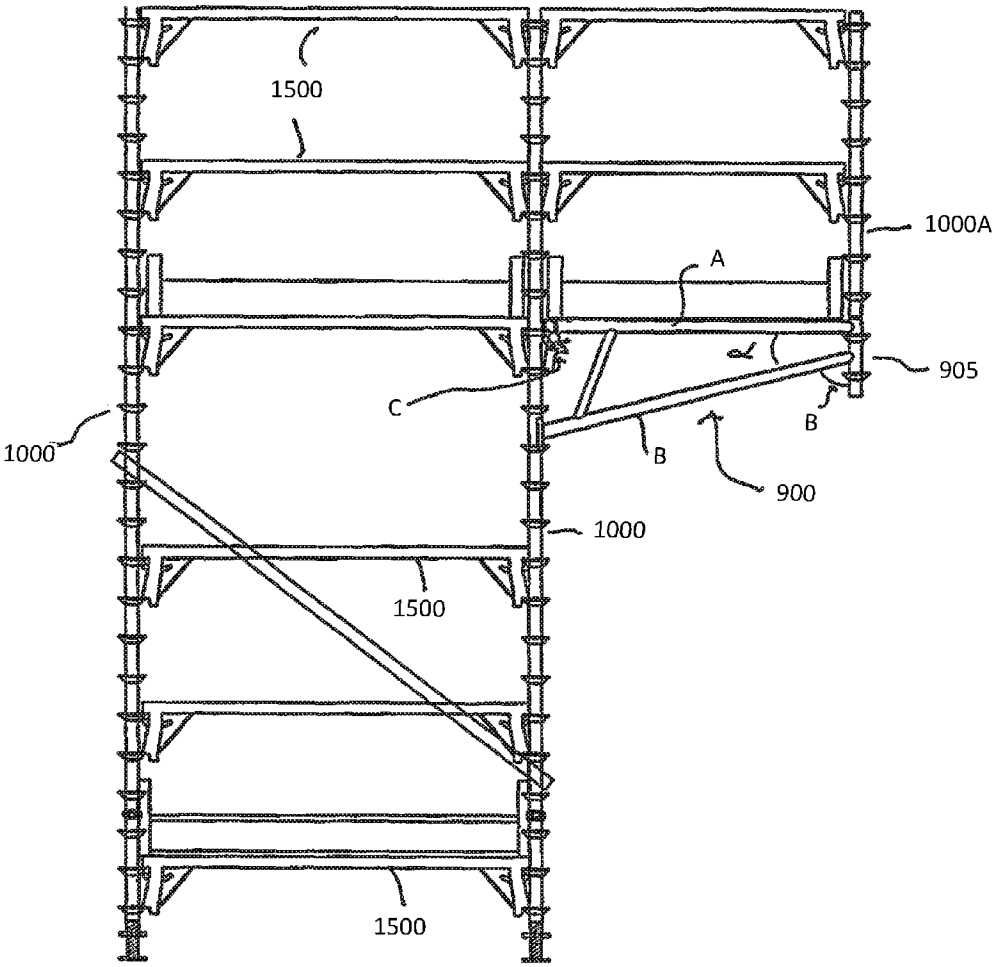
PRIOR ART FIGURE 1
FIG. 1 is a side view of a prior art box-like scaffold structure having a offset working surface attached through a welded knee-out section.

The preferred embodiment of the foldable knee-out scaffold frame member comprises two scaffold members (such as pipes), a first member 30, which will be the horizontal member when installed, and a second member 40, which will be the sloped bracing member or truss member) when installed. The two members 30 and 40 are pivotably joined at a pivot joint 50. Pivot joint 50, as shown, is two downward extending plates or fingers 51 positioned on opposing sides of first member 30, with an aligned opening through the two plates 51. Second member's 40 distal end is positioned between the two plates, and has an opening that aligns with those in the plates 51. A pivot pin is then inserted through the openings and fixed in place. See FIG. 2. The plates 51 may also be positioned on the second member 40.

Each member 30, 40 terminates in a scaffold frame connector 31 and 41, respectively. The connector may be any scaffold latch (a means for latching to a scaffold frame member) suitable for use in a modular scaffold system, or the connector may be a means for clamping to a scaffold frame member, such as the "U" clamp member 90 shown in FIG. 3. A clamp member may clamp to a horizontal or vertical member, while a latch member generally latches to a vertical scaffold member. Preferably and as shown, each scaffold frame connector 31 and 41 is pivotably connected to its respective frame member 30, 40. This is preferred, but not necessary. For instance, the bottom scaffold frame connector 41 may be non-pivotably attachable to the second frame member 40. The pivot joints for the connectors 31 and 41, as shown, are plates 61 that extend rearwardly from the clamp or latch, spaced apart to accommodate the respective frame member (30 or 40) therebetween, with the proximal end of the respective scaffold member insertable between the plates 61, and pivotably fixed in position with a pin 63 through aligned openings (see FIG. 2B). Other pivotable connectors are possible, and the frame members 30, 40 may also have plates that pivotably join with the scaffold frame connector.

Figure 4:
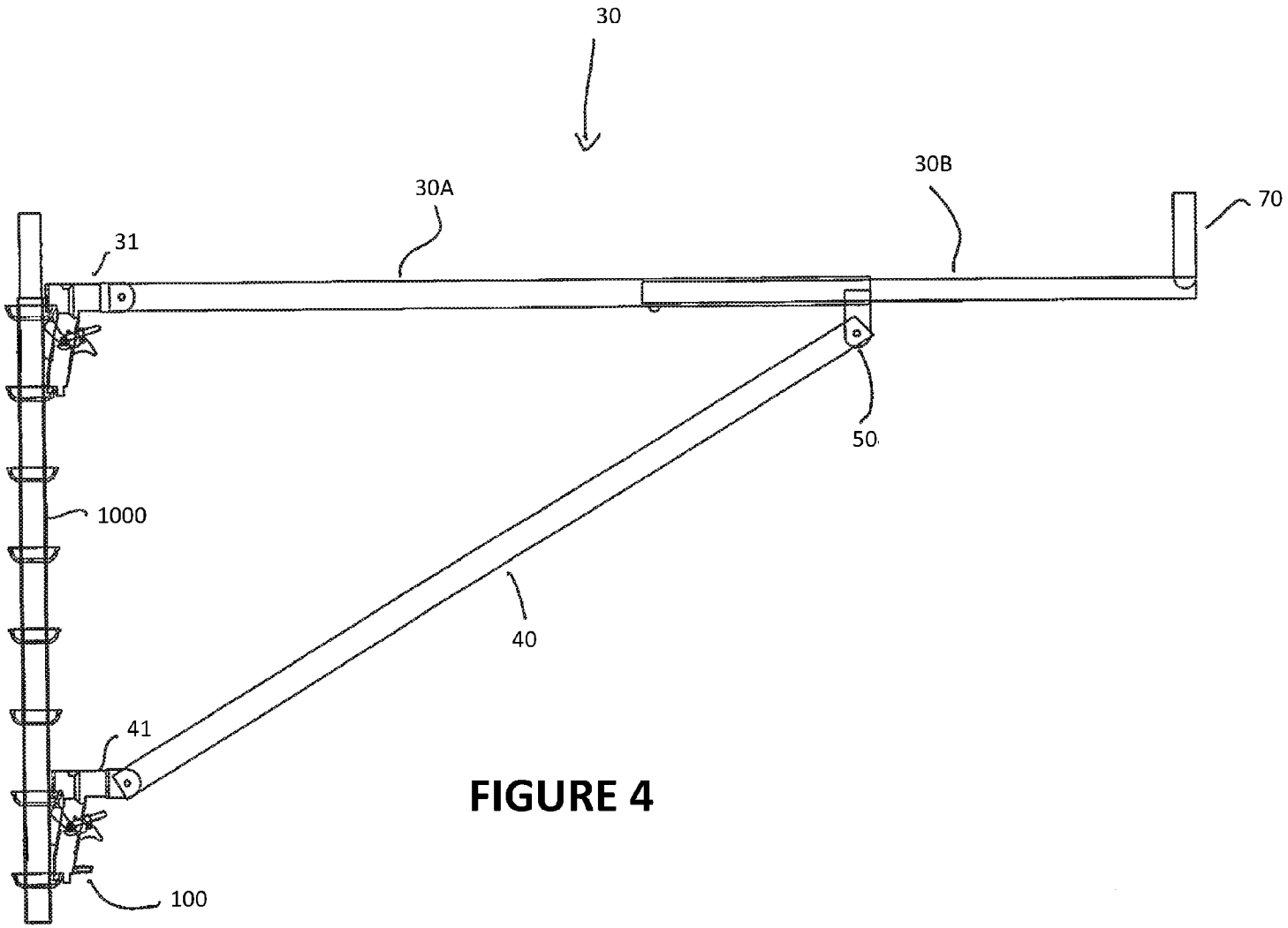
FIG. 4 depicts a side view of another embodiment of the folded scaffold knee-out brace attached to a vertical scaffold member, with a telescoping top member.

Additionally, the first frame member 30 may have an adjustable pivot point 51. For instance, the two plates 51 may be attached to a separate clamp, where the clamp is slidable along the first scaffold member 30 when the clamp is loose (not shown), but fixed in position with respect to the first scaffold member 31 when the clamp is tight (not shown). This arrangement allows the join location of the first and second members to be easily adjusted. For added flexibility, the first scaffold member 30 may be composed of two members 30A and 30B, with 30B slidably inserted into the member 30A (see FIG. 4) (or vice versa), thereby allowing for an extendable first member 30 in the foldable knee-out member. Once the desired extension of the member 30B is reached, the position of the member 30B should be fixed (e.g. clamped in position, or using a locking system, for instance, such as having a push button on the member 30B alignable with a series of holes in the member 30A, or alternatively, a slot in the member 30A with a bolt, slidable in the slot, threadably attached to member 30B. Other means of fixing member 30B to member 30A can be utilized. This telescoping two member construction may also be employed in the second member 40.

Figure 2:
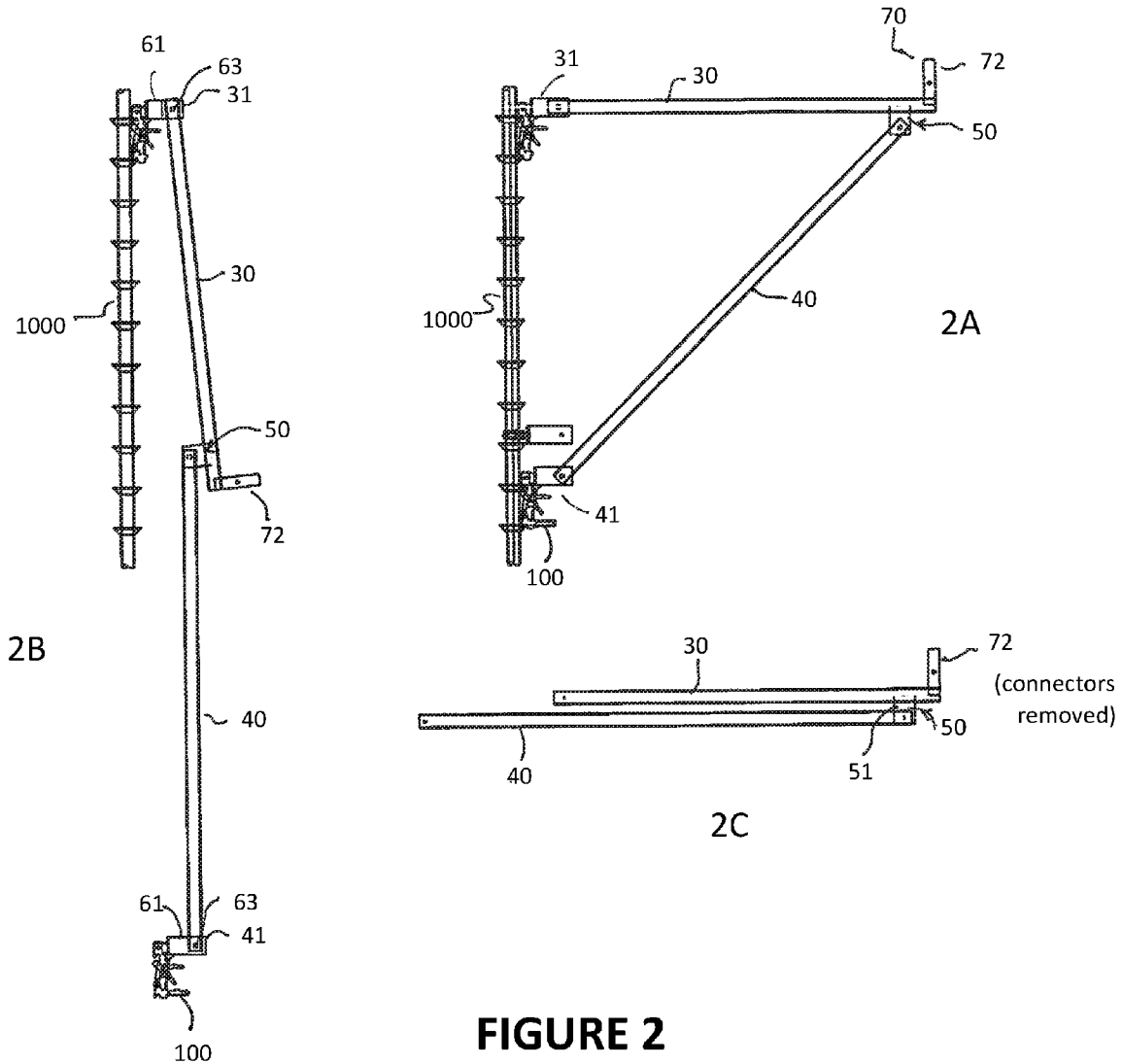
FIG. 2A depicts a side view of one embodiment of the foldable scaffold knee-out brace connected to a vertical scaffold member.
FIG. 2B depicts a side view of one embodiment of the foldable scaffold knee-out brace attached to a vertical scaffold member at the top joint alone.
FIG. 2C depicts a side view of one embodiment of the foldable scaffold knee-out brace in a folded configuration, with the end connectors removed.
Figure 3:
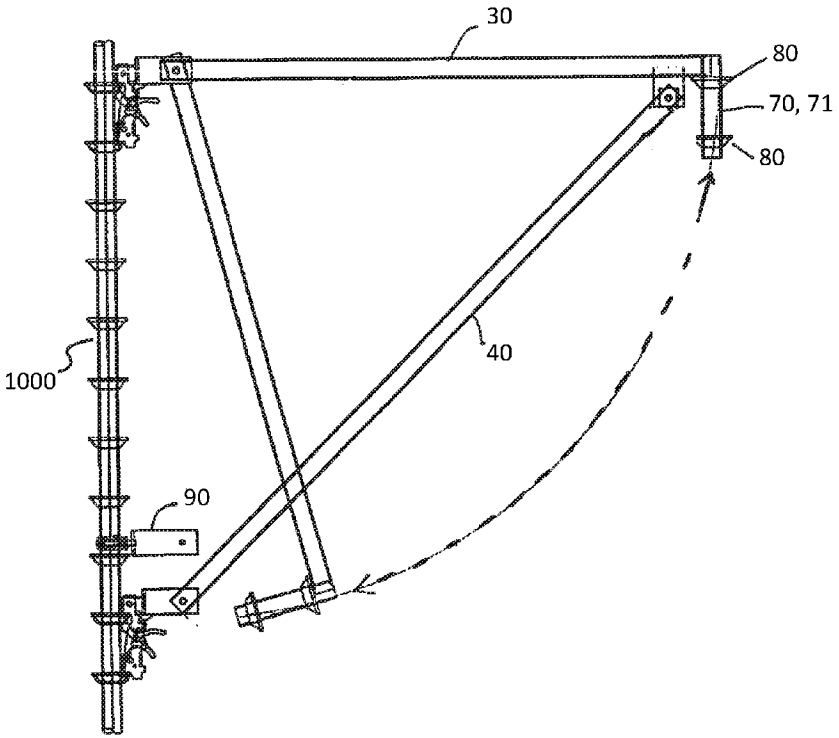
FIG. 3 depicts a side view of another embodiment of the foldable scaffold knee-out brace attached to a vertical scaffold member.
Figure 3:
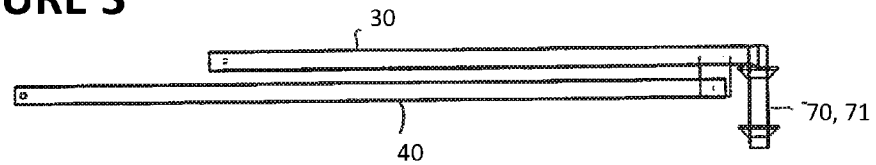

As shown in FIG. 2A, the distal end of the first knee-out frame member 30 preferably ends in a vertical connector 70. The vertical connector 70, while not necessary, allows for attachment of other horizontal or vertical scaffold frame members to the knee out structure. For instance, a guard rail surrounding the knee-out structure may be attached using this vertical connector, much that that shown in FIG. 1. One embodiment of the vertical connector 70, shown in FIG. 2, is an upwardly extending pipe stub 72, sized to allow a vertical scaffold member to slide over the stub 72, or alternatively, sized to allow a vertical scaffold member to be insertable into the stub 72. An alternative vertical member 70 is depicted in FIG. 3, shown as a downwardly extending pipe stub 71 having several annular rings 80, adapted to engage a scaffold latch member (this member 72 could also be upwardly extending).

The preferred method of attaching a foldable knee-out frame member to a scaffold frame is as follows. The first member's 30 scaffold end connector 31 is attached to the desired location on the scaffold frame. The first and second members 30 and 40 hang almost straight downward for the attached end connector 31. See FIG. 2B. The installer would then descend to a lower location on the frame structure, grasp one of the hanging knee-out frame members (preferably second member 40), and begin lifting that member upwardly. To assist the installer, the connector 41 (or pivot plates 51) may include a handle 100, to provide an easy griping surface for the installer when applying an upward force to the second scaffold member 40. This upward movement results in the upward and outward movement of the couple location 50 of the first 30 and second 40 scaffold members, as indicated by the dashed line in FIG. 3. As the first 30 and second members 40 are supported to a vertical scaffold member on a scaffold frame by the first member's 30 scaffold connector 31, this motion is not difficult to achieve. The installer continues lifting until the second member's 40 scaffold end connector 41 is suitably positioned for attachment to the frame structure (e.g. when the top member 30 is substantially horizontal), and the end connector 41 is then fixedly attached to the desired location on the vertical member 1000. The method of attaching can be reversed (i.e. attach the lower bottom connector 41 first), but this is not preferred as the weight of the two members for this type of installation is not top supported.

After two foldable knee-out sections are installed on the scaffold structure at substantially the same height, scaffold flooring, such as scaffold planks, may be supportedly positioned between the first and second foldable knee-out sections to create a working surface.

In transport, the foldable knee-out section may be folded into a compact structure (first member positioned adjacent the other) by folding (e.g. pivoting) about the pivot joint 50, as shown in FIG. 2C (shown with end connectors 31 and 41 removed). The folded knee-out is compact, allowing users to transport the brace through limited access entries, such as a man-ways in a tank such as a boiler tanks, for assembly, such as assembly inside a tank. The prior art welded knee-out structure was not suitable for transport through limited access openings.

The invention claimed is:

1. A method of creating an offset working surface to an assembled scaffold structure, said assembled scaffold structure comprising a first and second vertical scaffold members, said first and second vertical scaffold members spaced apart and connected by spaced apart first and second horizontal scaffold members, said assembled first and second vertical and horizontal scaffold members creating a planar scaffold structure, said method comprising the steps of:

(a) providing a first and a second scaffold knee-out member, each scaffold knee-out member having:

a first scaffold member and a second scaffold member, said first scaffold member having a distal and proximal end, said second scaffold member having a distal and proximal end, a first scaffold connector pivotally positioned on said proximal end of said first scaffold member, said first scaffold connector adapted to couple to a vertical scaffold member, said distal end of said second scaffold member pivotally coupled to said distal end of said first scaffold member, and said proximal end of said second scaffold member having a second scaffold connector mounted thereon, said second scaffold connector adapted to couple to a vertical scaffold member;

(b) coupling said first knee-out member to said first vertical scaffold member by:

(i) coupling said first scaffold connector of said first knee-out member to said first vertical scaffold member at a first couple location, with said first and second scaffold members of said first knee-out member supported and hanging downwardly from said first couple location, substantially parallel to said first vertical scaffold member;

(ii) lifting said first knee-out member's second scaffold member upwardly, to thereby pivot said first scaffold member of said first knee-out member with respect to said second scaffold member of said first knee-out member and to pivot said first scaffold member of said first knee-out member outwardly from said planar scaffold structure, until said first scaffold member of said first knee-out member is substantially horizontal;

(iii) coupling said second scaffold connector to said first vertical scaffold member at a second couple location position below said first couple location;

(c) coupling said second knee-out member to said second vertical scaffold member by:

(i) coupling said first scaffold connector of said second knee-out member to said second vertical scaffold member at a first couple location, with said first and second scaffold members of said second knee-out member supported and hanging downwardly from said first couple location on said second vertical scaffold member;

(ii) lifting said second knee-out member's second scaffold member upwardly, to thereby pivot said first scaffold member of said second knee-out member with respect to said second scaffold member of said second knee-out member and to pivot said first scaffold member of said second knee-out member outwardly from said planar scaffold structure until said first scaffold member of said second knee-out member is substantially horizontal;

(iii) coupling said second scaffold connector on said second knee-out member to said second vertical scaffold member at a second couple location position below said first couple location on said second vertical scaffold member; and (d) positioning and supporting a scaffold flooring horizontally on said first knee-out member's first scaffold member and said second knee-out member's first scaffold member to provide a working surface.

2. The method of claim 1 wherein each of said first and second knee-out members further comprise a stub out member fixedly attached to said distal end of said first scaffold member, said stub out orientated to be substantially vertical when said first scaffold member is substantially horizontal; said method further comprising the steps of coupling a third vertical scaffold member to said stub out on said first knee-out member, coupling a fourth vertical scaffold member to said stub out on said second knee-out member, and coupling a horizontal member to said third and fourth vertical scaffold members.

3. The method of claim 1 wherein said first scaffold connectors of said first and second knee-out members are adapted to couple to two vertically spaced apart ring members on the respective first and second vertical scaffold members.

4. The method of claim 1 wherein said second scaffold connectors of said first and second knee-out members are pivotally positioned on said proximal end of the respective second scaffold member.

5. The method of claim 1 wherein said distal ends of said first and second scaffold members, on one of said first or second knee-out members, are slidably coupled.

6. The method of claim 1 wherein each of said proximal ends of said second scaffold members further comprises an outwardly protruding operator grip.

7. The method of claim 1 wherein each of said first scaffold members proximal end further comprises a proximal member and said distal end further comprises a distal member, said proximal and distal members being slidably mounted with respect to each other.

* * * * *